US008251655B2

(12) United States Patent
Chen et al.

(10) Patent No.: US 8,251,655 B2
(45) Date of Patent: Aug. 28, 2012

(54) FAN AND FRAME WITH SENSOR-SUPPORTING STRUCTURE THEREOF

(75) Inventors: Meng-Yu Chen, Taoyuan Hsien (TW); Te-Tsai Chuang, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 846 days.

(21) Appl. No.: 12/168,585

(22) Filed: Jul. 7, 2008

(65) Prior Publication Data

US 2009/0016879 A1 Jan. 15, 2009

(30) Foreign Application Priority Data

Jul. 10, 2007 (TW) ..... 96125038 A

(51) Int. Cl.
*F04D 29/52* (2006.01)

(52) U.S. Cl. ..... 415/220; 415/118; 415/119

(58) Field of Classification Search ..... 415/118; 416/61
See application file for complete search history.

(56) References Cited

U.S. PATENT DOCUMENTS 5,367,604 A * 11/1994 Murray ..... 392/394
5,478,199 A * 12/1995 Gliebe ..... 415/119
6,953,424 B2 * 10/2005 Kusumoto et al. ..... 494/10
6,981,838 B2 * 1/2006 McKee et al. ..... 415/1
7,340,942 B2 * 3/2008 Matsuo et al. ..... 73/31.05

* cited by examiner

*Primary Examiner* — Thao Le
*Assistant Examiner* — Sheng Zhu
(74) *Attorney, Agent, or Firm* — Muncy, Geissler, Olds & Lowe, PLLC

(57) ABSTRACT

A fan and a frame with a sensor-supporting structure are disclosed. The fan includes a frame with an inlet, a connecting portion disposed on the frame, a stator, and a rotor having blades and disposed in the frame. The frame includes a main body and a sensor-supporting structure. The sensor-supporting structure extending from the main body toward the inlet is utilized to support a sensor.

16 Claims, 7 Drawing Sheets

FAN AND FRAME WITH SENSOR-SUPPORTING STRUCTURE THEREOF

CROSS REFERENCE TO RELATED APPLICATIONS

This Non-provisional application claims priority under 35 U.S.C. §119(a) on Patent Application No(s). 096125038, filed in Taiwan, Republic of China on Jul. 10, 2007, the entire contents of which are hereby incorporated by reference.

BACKGROUND OF THE INVENTION

1. Field of the Invention

The present invention relates to a fan and a frame with a sensor-supporting structure thereof, and more particularly to a fan and a frame with a sensor-supporting structure for increasing product reliability and design creditability.

2. Description of the Related Art

With rapid progress of technology, consumers have more requirements for vehicle electronic equipments, particularly for vehicle air-conditioning systems capable of providing suitable environmental temperature for the driver and passengers.

For traditional vehicle designs for maintaining the same temperature in the vehicle, temperature-sensing conductors are set in the interior of the vehicle which are utilized to transmit temperature signals to sensors embedded in the vehicle body, and a circuit system receives and transmits the detected temperature signals to a vehicle computer to adjust the air-condition system. However, because more heat is transferred to the vehicle body and the interior of the vehicle from outdoors, the detected temperature is often different from the actual temperature inside the vehicle. A fan with temperature sensors is therefore developed. With the fan expelling inside vehicle airflow to pass through the temperature sensors disposed thereon, an actual inside vehicle temperature can be obtained.

In FIGS. 1A and 1B, a conventional fan 1 is provided with a temperature sensor 10, a body 11, a set of terminals 12 and lead wires 14, and a plurality of blades 13. The temperature sensor 10 suspending in an inlet "O" is connected to the set of lead wires 14 and terminals 12, thereby transmitting the detected temperature signals to an external system. However, due to the temperature sensor 10 being fully supported by the stiffness of the lead wire 14, vibrations from the vehicle usually cause dislocation of the temperature sensor 10. When the dislocated temperature sensor 10 accidentally approaches the blades 13, the dislocated temperature sensor 10 or the lead wires 14 are damaged by the rotating blades 13, resulting in malfunction of temperature detection.

BRIEF SUMMARY OF THE INVENTION

To solve the aforementioned problems, the present invention provides a fan and a frame with a sensor-supporting structure to support a sensor. Additional assembling elements are not required for the fan of the present invention, thus, cost and the assembly hours for the fan can be reduced. Further, during vehicle operation, the damage of the sensor disposed on the fan caused by vibrations can be prevented and temperature detection thereof can be stably maintained.

To achieve the above objectives, the present invention provides a fan and a frame with a sensor-supporting structure thereof. The frame includes a main body and a sensor-supporting structure. The main body has an inlet. The sensor-supporting structure utilized to support a sensor extends from the main body toward the inlet. Further, the present invention provides a fan which includes a frame, a connecting portion disposed on the frame, a stator, and a rotor having blades and disposed in the frame. The frame includes a main body with an inlet and a sensor-supporting structure. The sensor-supporting structure extending from the main body toward the inlet is utilized to support a sensor. Airflow passes through the inlet of the frame.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the present invention. This description is made for the purpose of illustrating the general principles of the present invention and should not be taken in a limiting sense. The scope of the present invention is best determined by reference to the appended claims.

Figure 1A:
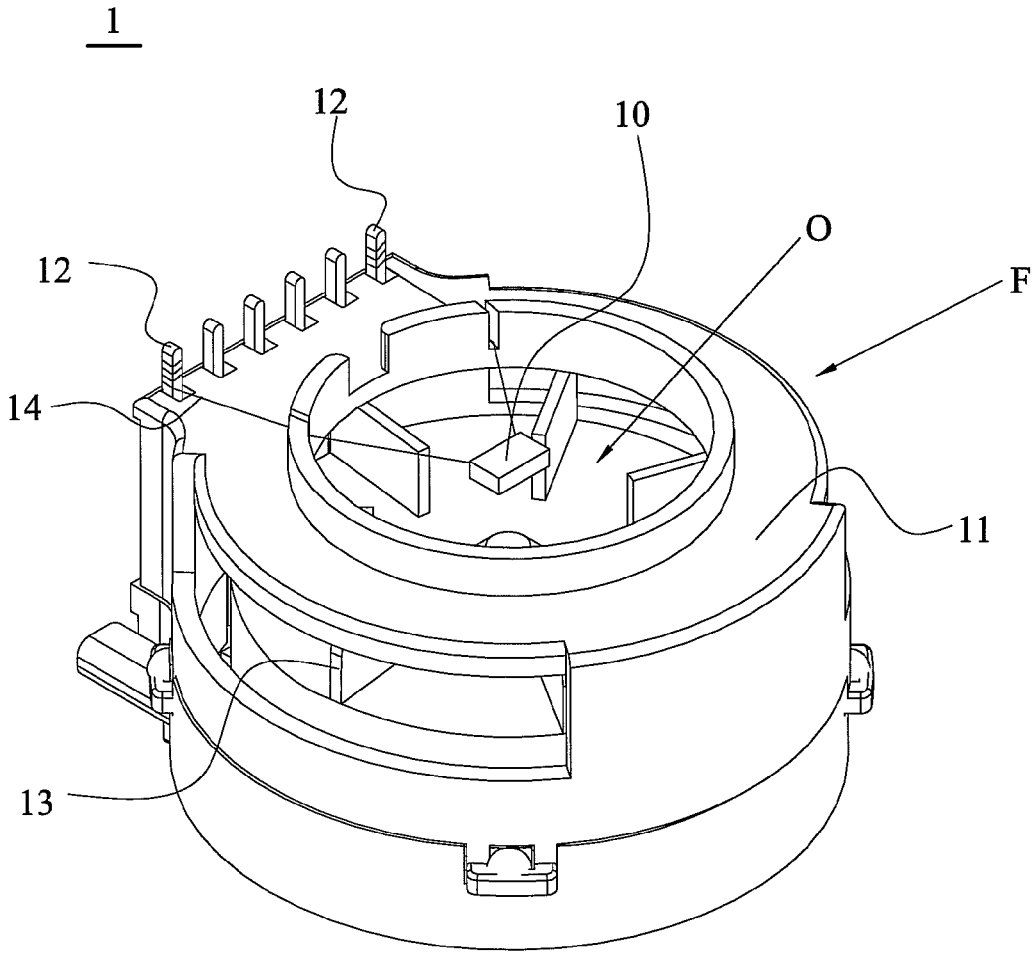
FIG. 1A (PRIOR ART)
FIG. 1A is a schematic illustration of a conventional fan.
Figure 1B:
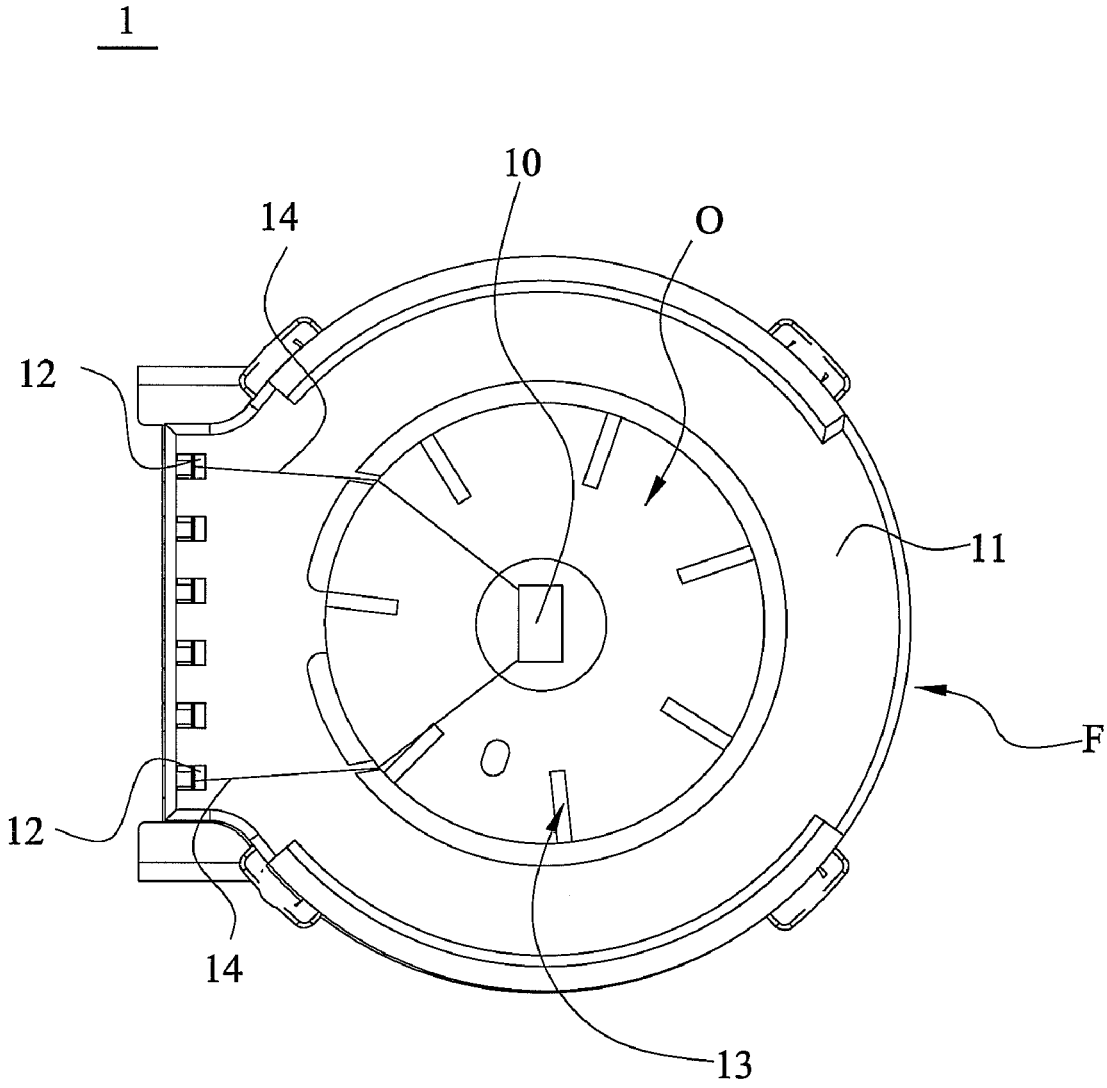
FIG. 1B (PRIOR ART)
FIG. 1B is a top view of FIG. 1A.
Figure 2A:
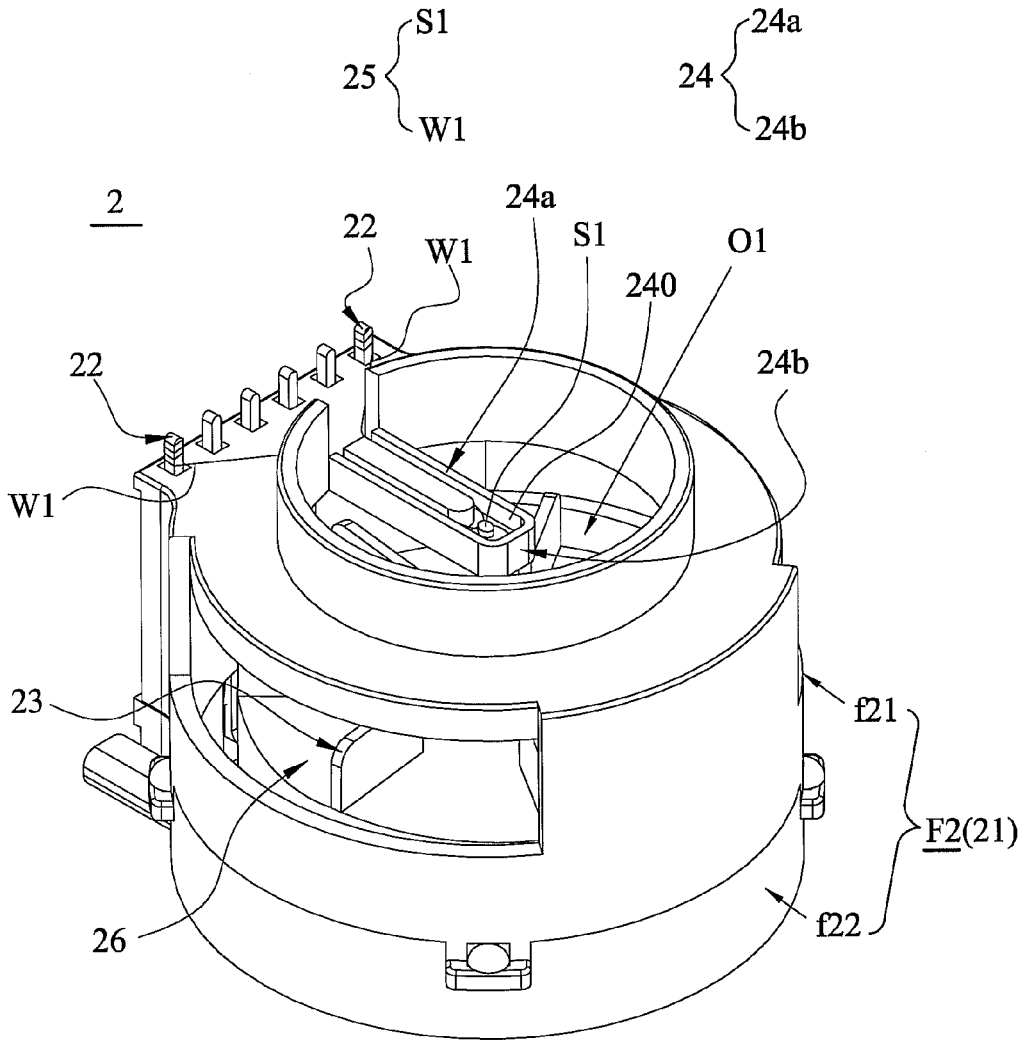
FIG. 2A is a schematic illustration of a fan of a first embodiment of the present invention.
Figure 2B:
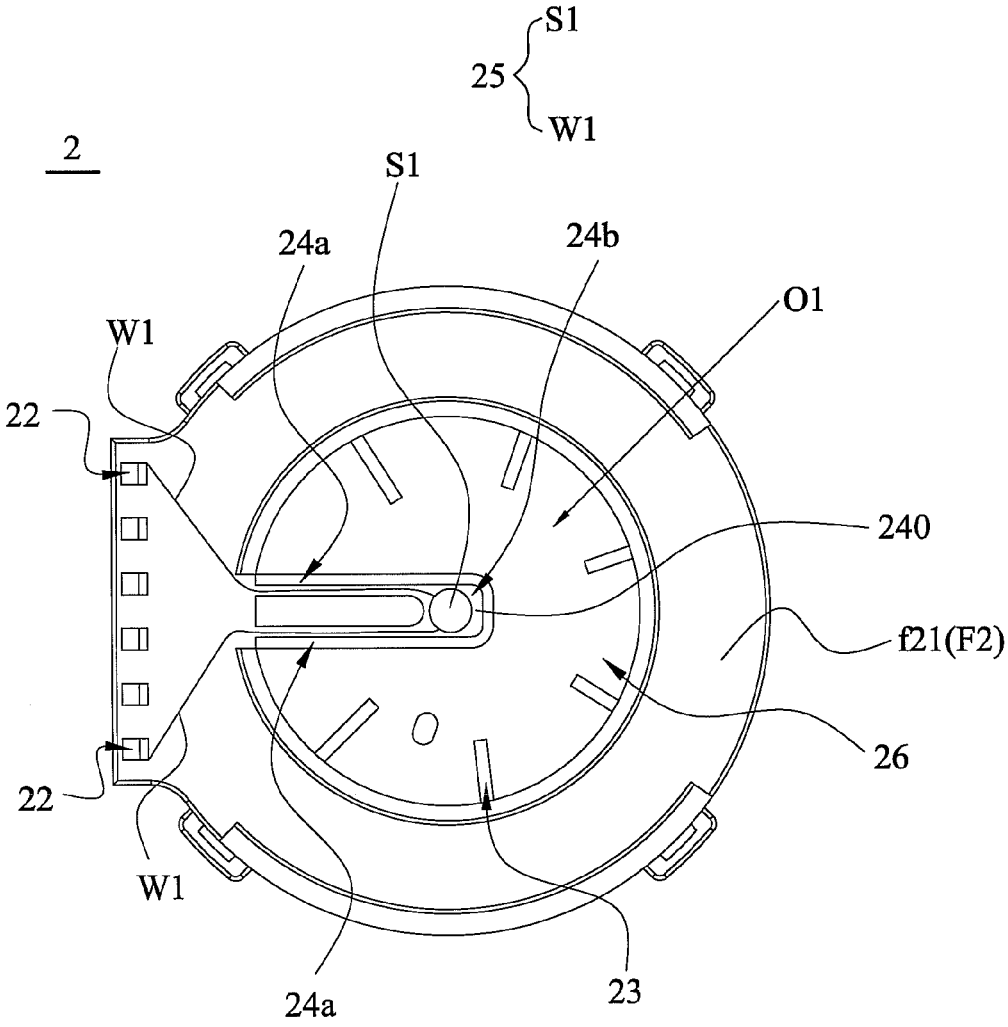
FIG. 2B is a top view of FIG. 2A.
Figure 2C:
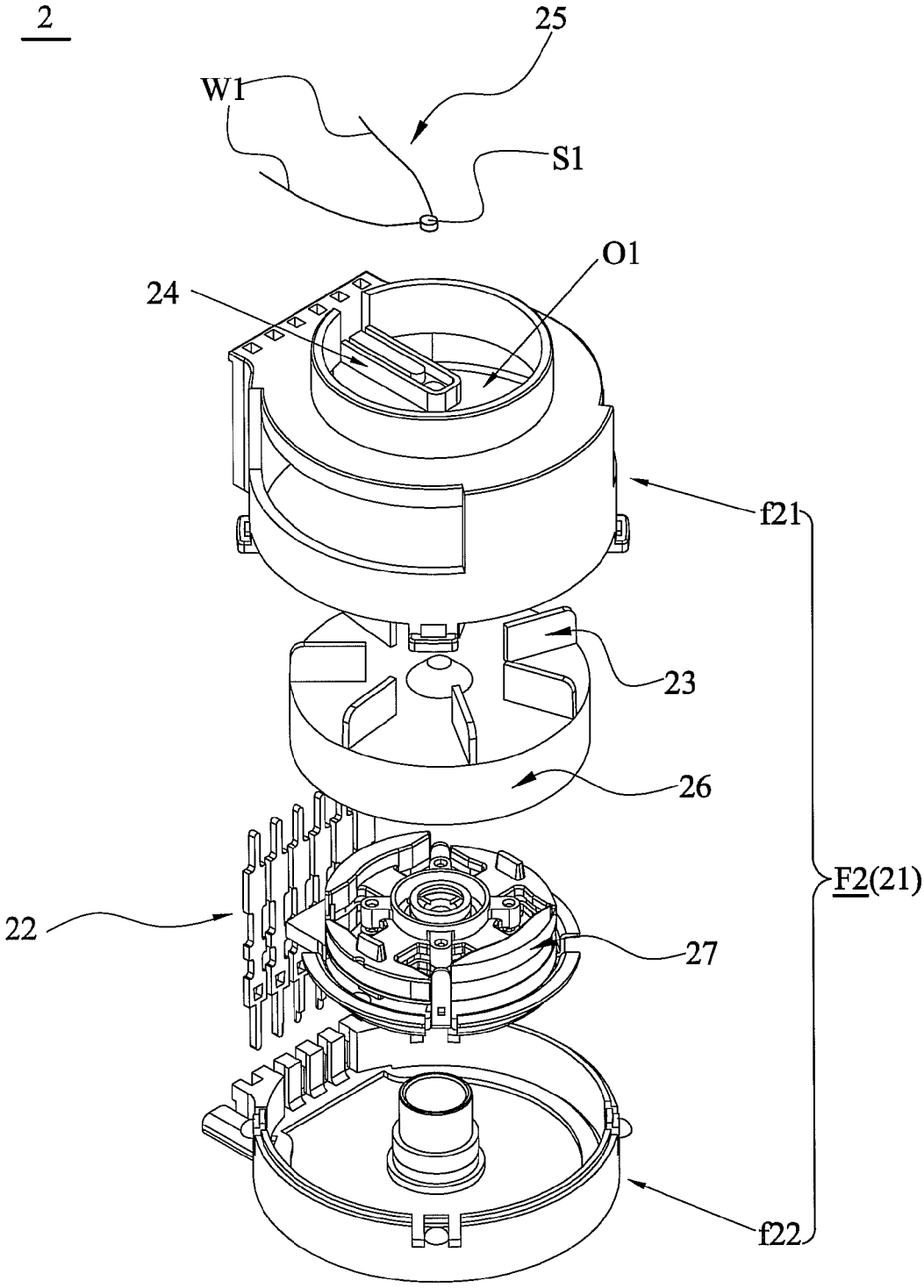
FIG. 2C is an exploded view of FIG. 2A.

In FIGS. 2A, 2B and 2C, the fan 2 of the first embodiment applied with a sensor 25 thereon, e.g. temperature or humidity sensor, includes a frame F2, a connecting portion 22 disposed outside of the frame F2, a rotor 26 having blades 23, and a stator 27. The frame F2 includes a main body 21 which is constituted by an upper main body f21 and a lower main body f22. The upper main body f21 of the frame F2 has an inlet O1, a sensor-supporting structure 24, and the sensor-supporting structure 24 is located close to the inlet O1. Airflow enters the inner of the fan 2 via the inlet O1 of the upper main body f21 of the frame F2. The sensor-supporting structure 24, extending from the upper main body f21 toward the inlet O1 where the airflow passes, is utilized to support the sensor 25. The sensor 25 includes leadwire portions W1 connected to the connecting portion 22 and an element portion S1 connected to the leadwire portions W1. In this embodiment, the connecting portions 22 are several terminals electrically connected to the element portion S1 via the leadwire portions W1.

The rotor 26 and the stator 27 are disposed within the fan 2 and are located in the upper main body f21. With the electromagnetic induction between the rotor 26 and the stator 27, the blades 23 driven by the rotated rotor 26 generate airflows. With the leadwire portions W1 of the sensor 25, signal such as temperature sensed by the element portion S1 of the sensor 25 is transmitted to an external system (not shown in Figs) via the connecting portion 22. In this embodiment, the upper main body f21 and the sensor-supporting structure 24 are integrally formed as a single piece by molding. It is understood that formation is not limited hereto; the upper main body f21 and the sensor-supporting structure 24 can be two separable elements for assembly (such as by buckling). The sensor-supporting structure 24 includes a leadwire supporting portion 24*a* directly connected to the upper main body f21 and an element supporting portion 24*b* connected to the upper main body f21 via the leadwire supporting portion 24*a*. In this embodiment, the leadwire supporting portion 24*a* and the element supporting portion 24*b* are integrally formed as a single piece by molding. The sensor-supporting structure 24 connects with the upper main body f21. However, it is to be understood that the present invention is not limited to the disclosed embodiment. The sensor-supporting structure 24 can be located in any sites of the frame F2 as long as the sensor-supporting structure 24 is close to the inlet O1 to detect the airflow. In addition, the inlet O1 can also be located in the lower main body f22. Moreover, the frame F2 can also be integrally formed as a single piece without combining the upper main body f21 and the lower main body f22.

The leadwire supporting portion 24*a* has a U-shaped or hollow rectangular cross section for receiving or supporting the leadwire portions W1 of the sensor 25. For example, if the cross section of the leadwire supporting portion 24*a* is U-shaped, a slot thereof is provided with a predetermined direction d2 along the leadwire portion W1 of the sensor 25, thereby securing the leadwire portion W1 of the sensor 25 to be functionally located at the leadwire supporting portion 24*a*. Likewise, by forming the shape of the element supporting portion 24*b* of the sensor-supporting structure 24 to correspond to the element portion S1 of the sensor 25, the element portion S1 of the sensor 25 is securely positioned on the element supporting portion 24*b* of the sensor-supporting structure 24. Thus, dislocation of the element portion S1 of the sensor 25 caused by large airflow or vibration from vehicle and damaged by the suction of the blades 23 of the rotating rotor 26 can be prevented. The element supporting portion 24*b* of the sensor-supporting structure 24 includes an accommodating space 240 utilized to receive the element portion S1 of the sensor 25. The profile and size of the accommodating space 240 of the element supporting portion 24*b* correspond to that of the element portion S1 of the sensor 25, respectively. As shown in FIG. 2A, the sensor 25 can be securely positioned as the element portion S1 is received in the accommodating space 240 of the element supporting portion 24*b* and one part of the leadwire portion W1 is received in the leadwire supporting portion 24*a*.

Figure 3A:
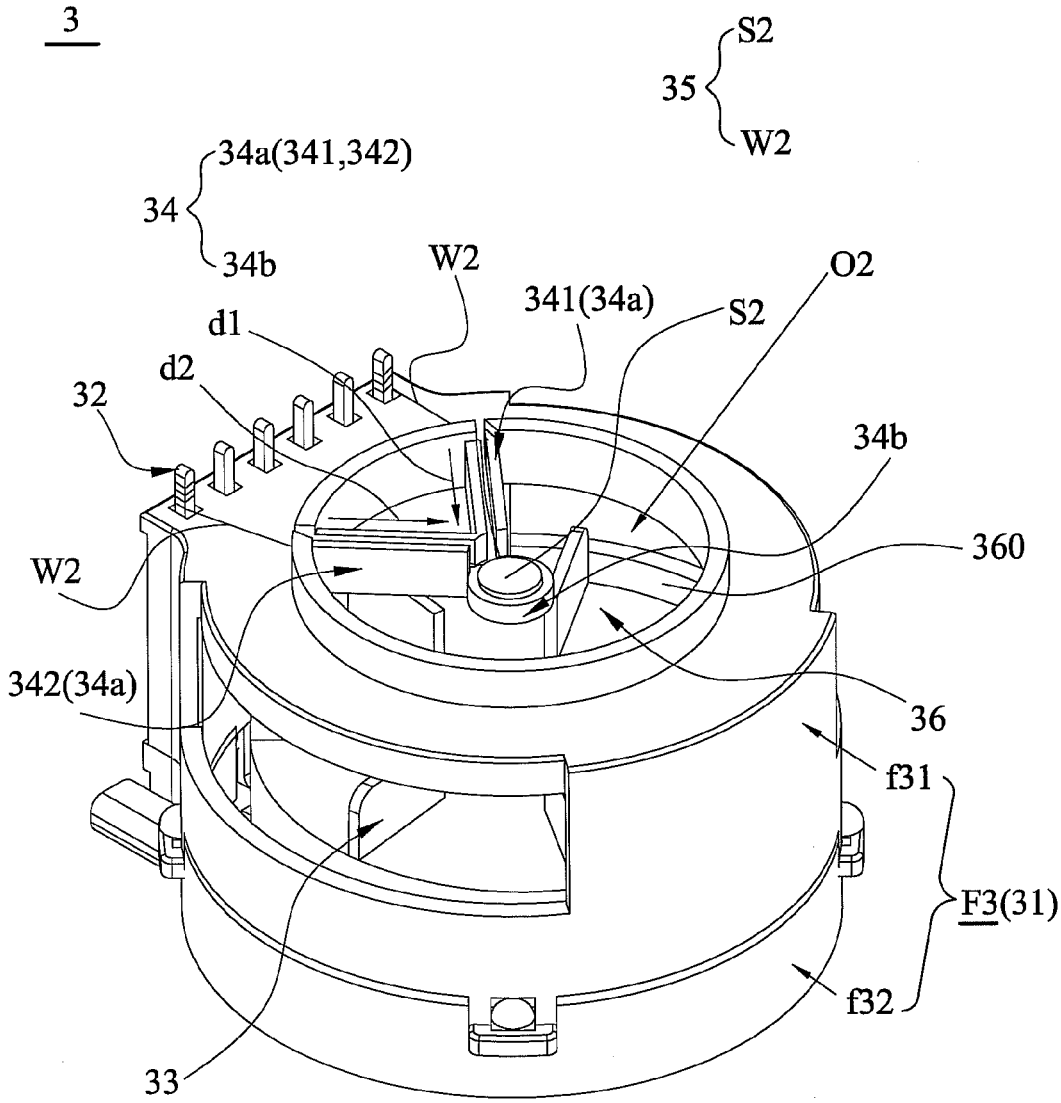
FIG. 3A is a schematic illustration of a fan of a second embodiment of the present invention.
Figure 3B:
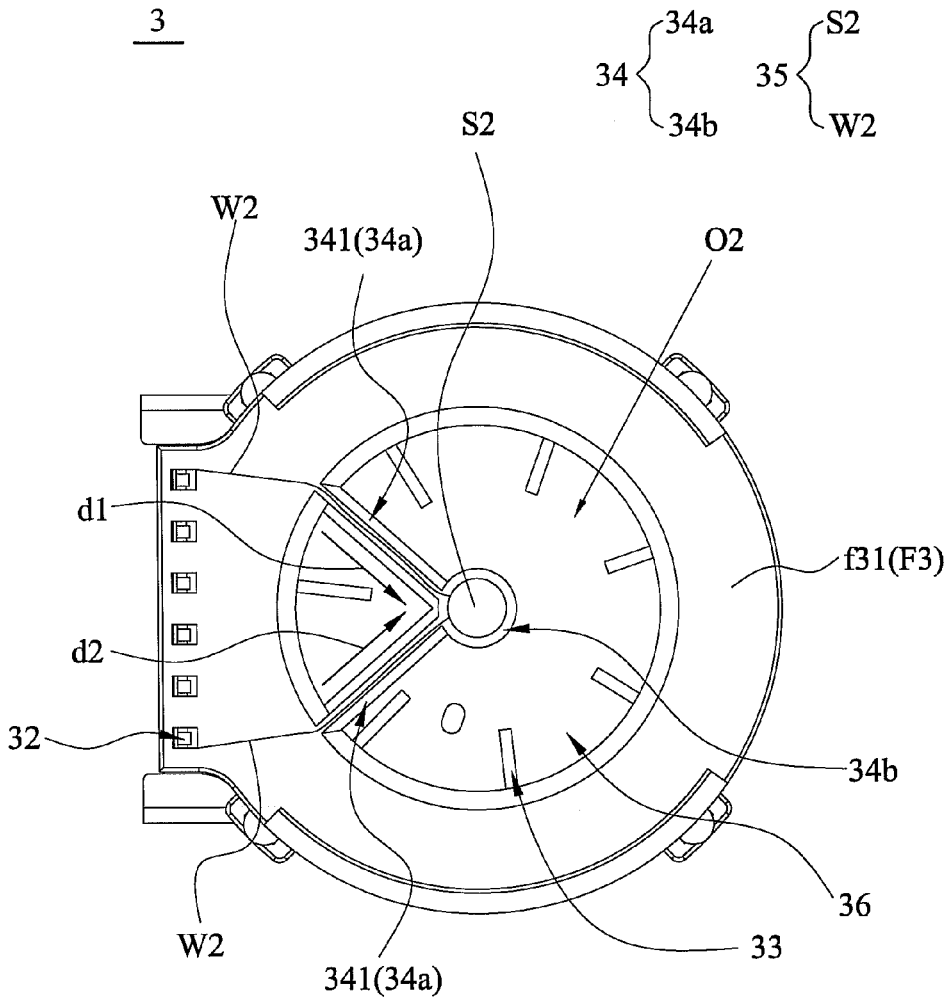
FIG. 3B is a top view of FIG. 3A.

Referring to FIGS. 3A and 3B, a fan 3 of a second embodiment, applied with a sensor 35 thereon, includes a frame F3, a connecting portion 32 disposed outside of the frame F3, a rotor 36 having blades 33, and a stator (not shown) located in the frame F3. The frame F3 is formed by an upper main body f31 and a lower main body f32. The upper main body f31 includes an inlet O2 and a sensor-supporting structure 34. The sensor-supporting structure 34 connects with the upper main body f31. However, it is to be understood that the present invention is not limited to the disclosed embodiment. The sensor-supporting structure 34 can be in any sites of the frame F2 as long as the sensor-supporting structure 34 is located close to the inlet O2 to detect the airflow. In addition, the inlet O2 can also be located in the lower main body f32. Moreover, the frame F3 can also be integrally formed as a single piece without combining the upper main body f31 and the lower main body f32. Airflow enters the fan 3 via the inlet O2 of the upper main body f31 of the frame F3. The sensor 35 includes two leadwire portions W2, respectively, connected to the connecting portion 32, and both connected to an element portion S2.

The sensor-supporting structure 34 includes a leadwire supporting portion 34*a* and an element supporting portion 34*b*. The element supporting portion 34*b* is connected to the upper main body 131 of the frame F3 via the leadwire supporting portion 34*a*. The leadwire supporting portion 34*a* includes a first leadwire supporting sub-portion 341 and a second leadwire supporting sub-portion 342, both of which extend and protrude inwardly and radically from two different sites of the upper main body f31 with an angle α therebetween and then the first and second leadwire supporting sub-portions 341, 342 both meet and connect with the element supporting portion 34*b*.

The leadwire supporting portion 34*a* can be a slot with a U-shaped cross section for receiving the leadwire portions W2 of the sensor 35, and guiding the leadwire portions W2 along two predetermined directions d1 and d2, respectively. In this embodiment, the element supporting portion 34*b* can be a plane formed in circular or rectangular profile, but it is not limited thereto. That is, in FIG. 3A, the shape of the element portion S2 of the sensor 35 can be arbitrarily altered according to the requirement of clients, thereby increasing the flexibility of the application of the product.

Based on the described features of the embodiment, the fan provides the supporting structure connected to the frame thereof for supporting the sensor, thus, dislocation of a sensor caused by large airflow or vibration from vehicle and damaged by the suction of the blades of the rotating rotor can be prevented. Additionally, reliability of the fan is enhanced, accurate signals provided from the sensor can be transmitted to the external systems, thus, the external system can normally operate. Further, additional assembly elements are not required for the fan, thus, cost and the assembly hours for the fan can be reduced.

While the present invention has been described by way of example and in terms of the preferred embodiments, it is to be understood that the present invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A frame, comprising:

a main body having an inlet; and a sensor-supporting structure utilized to support a sensor, extending from the main body toward the inlet;

wherein the sensor is a temperature or humidity sensor, and the sensor-supporting structure extends and protrudes inwardly and horizontally from the main body, wherein the sensor-supporting structure comprises a leadwire supporting portion and an element supporting portion, and the leadwire supporting portion is directly connected to the main body, and the element supporting portion is connected to the main body via the leadwire supporting portion, wherein the leadwire supporting portion comprises a first leadwire supporting sub-portion and a second leadwire supporting sub-portion extending and protruding inwardly and radically from two sites of the main body with an angle therebetween.

2. The frame as claimed in claim 1, wherein the main body and the sensor-supporting structure are integrally molded as a single piece, or the main body and the sensor-supporting structure are two separable elements for assembly.

3. The frame as claimed in claim 1, wherein the main body is constituted by an upper main body and a lower main body, the upper main body having an inlet and a sensor- supporting structure, and the sensor-supporting structure is located close to the inlet.

4. The frame as claimed in claim 1, wherein the first leadwire supporting sub-portion and the second leadwire supporting sub-portion of the leadwire supporting portion both meet and connect with the element supporting portion.

5. The frame as claimed in claim 1, wherein the leadwire supporting portion and the element supporting portion are integrally molded as a single piece.

6. The frame as claimed in claim 1, wherein the sensor comprises a leadwire portion and an element portion, the element supporting portion comprises an accommodating space utilized to receive the element portion of the sensor, the profile of the accommodating space of the element supporting portion corresponds to that of the element portion of the sensor, and the size of the accommodating space of the element supporting portion corresponds to that of the element portion of the sensor.

7. The frame as claimed in claim 1, wherein the leadwire supporting portion comprises a U-shaped or hollow rectangular cross section and provides a predetermined direction for the leadwire portion of the sensor to extend.

8. A fan with a sensor, comprising:

a frame, comprising:

a main body having an inlet; and a sensor-supporting structure utilized to support the sensor, extending from the main body toward the inlet;

a stator disposed in the main body; and a rotor disposed in the main body, comprising blades;

wherein the sensor is a temperature or humidity sensor, and the sensor-supporting structure extends and protrudes inwardly and horizontally from the main body, wherein the sensor-supporting structure comprises a leadwire supporting portion and an element supporting portion, and the leadwire supporting portion is directly connected to the main body, and the element supporting portion is connected to the main body via the leadwire supporting portion, wherein the leadwire supporting portion comprises a first leadwire supporting sub-portion and a second leadwire supporting sub-portion extending and protruding inwardly and radically from two sites of the main body with an angle therebetween.

9. The fan as claimed in claim 8, wherein the main body and the sensor-supporting structure are integrally molded as a single piece, or the main body and the sensor-supporting structure are two separable elements for assembly.

10. The fan as claimed in claim 8, wherein the main body is constituted by an upper main body and a lower main body, the upper main body having an inlet and a sensor-supporting structure, and the sensor-supporting structure is located close to the inlet.

11. The fan as claimed in claim 8, wherein the first leadwire supporting sub-portion and the second leadwire supporting sub-portion of the leadwire supporting portion both meet and connect with the element supporting portion.

12. The fan as claimed in claim 8, wherein the leadwire supporting portion and the element supporting portion are integrally molded as a single piece.

13. The fan as claimed in claim 8, wherein the sensor comprises a leadwire portion and an element portion, the element supporting portion comprises an accommodating space utilized to receive the element portion of the sensor, and the profile of the accommodating space of the element supporting portion corresponds to that of the element portion of the sensor, and the size of the accommodating space of the element supporting portion corresponds to that of the element portion of the sensor.

14. The fan as claimed in claim 8, wherein the leadwire supporting portion comprises a U-shaped or hollow rectangular cross section and provides a predetermined direction for the leadwire portion of the sensor to extend.

15. The fan as claimed in claim 8, further comprising a connecting portion disposed outside of the frame, and wherein the connecting portion comprises a terminal electrically connected to the element portion of the sensor via the leadwire portion of the sensor, and a signal sensed by the sensor is transmitted to an external system via the connecting portion.

16. A frame, comprising:

a main body having an inlet, an upper main body, and a lower main body; and a sensor-supporting structure utilized to support a sensor, extending from the main body toward the inlet, wherein the upper main body and the lower main body are two separable elements for assembly by buckling;

wherein the sensor is a temperature or humidity sensor, and the sensor-supporting structure extends and protrudes inwardly and horizontally from the main body, wherein the sensor-supporting structure comprises a leadwire supporting portion and an element supporting portion, and the leadwire supporting portion is directly connected to the main body, and the element supporting portion is connected to the main body via the leadwire supporting portion, wherein the leadwire supporting portion comprises a first leadwire supporting sub-portion and a second leadwire supporting sub-portion extending and protruding inwardly and radically from two sites of the main body with an angle therebetween.

* * * * *